US012357107B2

(12) United States Patent
Yang

(10) Patent No.: US 12,357,107 B2
(45) Date of Patent: Jul. 15, 2025

(54) CRIB

(71) Applicant: TJ(fujian) Industrial Co.,Ltd., Zhangzhou (CN)

(72) Inventor: Jianbo Yang, Zhangzhou (CN)

(73) Assignee: TJ(fujian) Industrial Co., Ltd., Zhangzhou (CN)

( * ) Notice: Subject to any disclaimer, the term of this patent is extended or adjusted under 35 U.S.C. 154(b) by 210 days.

(21) Appl. No.: 18/125,132

(22) Filed: Mar. 23, 2023

(65) Prior Publication Data

US 2023/0346134 A1 Nov. 2, 2023

(30) Foreign Application Priority Data

Apr. 28, 2022 (CN) ..... 202220999504.9

(51) Int. Cl.
*A47D 7/00* (2006.01)
*A47D 7/01* (2006.01)
*A47D 9/00* (2006.01)

(52) U.S. Cl.
CPC ..... *A47D 7/007* (2013.01); *A47D 7/005* (2013.01); *A47D 7/01* (2013.01); *A47D 9/00* (2013.01); *A47D 7/00* (2013.01)

(58) Field of Classification Search
CPC ..... A47D 7/007; A47D 7/005; A47D 7/01; A47D 7/00; A47D 9/00
USPC ..... 5/93.1, 98.1, 11
See application file for complete search history.

(56) References Cited

U.S. PATENT DOCUMENTS 2,381,759 A * 8/1945 Lanese ..... A47D 9/00 5/93.2
2,401,605 A * 6/1946 Boren ..... A61G 11/009 5/655
2,569,555 A * 10/1951 Chanslor et al. ..... A47D 9/016 108/190
3,146,736 A * 9/1964 Hetrick ..... A47D 9/005 5/98.1
D266,209 S * 9/1982 Rogers ..... D6/386
D388,640 S * 1/1998 Burgin ..... D6/390
(Continued)

FOREIGN PATENT DOCUMENTS

CN 207561646 U 7/2018
CN 212546366 U 2/2021
(Continued)

*Primary Examiner* — Robert G Santos
(74) *Attorney, Agent, or Firm* — Bayramoglu Law Offices LLC

(57) ABSTRACT

A crib includes a left support mechanism, a right support mechanism, and a sleeping basket frame provided between the left support mechanism and the right support mechanism. The sleeping basket frame is height-adjustable. A detachable support frame and a detachable storage frame are further provided between the left support mechanism and the right support mechanism. The support frame is located below the sleeping basket frame, and the storage frame is located below the support frame. The crib has a novel structure and clever design. A sleeping basket is height-adjustable, so the height of the sleeping basket can be adjusted according to actual needs. The storage frame is configured to support a storage basket for storing baby items, such as diapers and clothes. Therefore, it is convenient for the parent to get the diaper or clothing from the storage basket to change the baby.

3 Claims, 6 Drawing Sheets

(56) References Cited

U.S. PATENT DOCUMENTS 6,588,033 B1 * 7/2003 Welsh, Jr. ..... A47D 7/002 5/98.1
6,704,949 B2 * 3/2004 Waldman ..... A47D 7/007 5/98.1
6,886,195 B2 * 5/2005 Rimbau Vidal ..... A47D 9/005 5/99.1
6,907,626 B1 * 6/2005 Welsh, Jr. ..... A47D 9/005 5/98.1
6,934,981 B2 * 8/2005 Waldman ..... A47D 9/02 5/98.1
7,070,188 B2 * 7/2006 Waldman ..... B60B 33/0005 280/87.051
7,788,744 B2 * 9/2010 Calilung ..... A47D 9/02 5/101
9,883,750 B2 * 2/2018 Yi ..... A47D 9/012
D839,625 S * 2/2019 Sclare ..... D6/390
10,477,982 B2 * 11/2019 Damiani ..... A47D 15/001
D877,527 S * 3/2020 Gopaul ..... D6/390
11,259,651 B2 * 3/2022 Zhang ..... A47C 7/543
D990,911 S * 7/2023 Yi ..... D6/390
11,730,284 B2 * 8/2023 Yang ..... A47D 9/012 5/98.1
D1,011,066 S * 1/2024 Ou ..... D6/390
D1,011,067 S * 1/2024 Ou ..... D6/390
D1,011,068 S * 1/2024 Yang ..... D6/390
11,882,946 B2 * 1/2024 Zhang ..... A47C 7/543
D1,017,269 S * 3/2024 Li ..... D6/390
D1,021,450 S * 4/2024 Yang ..... D6/390
D1,027,481 S * 5/2024 Gao ..... D6/390
D1,028,556 S * 5/2024 Qi ..... D6/390
D1,028,593 S * 5/2024 Xu ..... D6/391
D1,044,374 S * 10/2024 Mo ..... D6/718.26
D1,045,431 S * 10/2024 Jiang ..... D6/390
D1,049,686 S * 11/2024 Jiang ..... D6/390
D1,050,755 S * 11/2024 Xing ..... D6/390
2003/0177574 A1 * 9/2003 Waldman ..... A47D 11/005 5/2.1
2004/0133977 A1 * 7/2004 Rimbau Vidal ..... A47D 9/005 5/99.1
2004/0181873 A1 * 9/2004 Waldman ..... A47D 11/005 5/99.1
2005/0005353 A1 * 1/2005 Waldman ..... A47D 9/012 5/101
2005/0098969 A1 * 5/2005 Waldman ..... B60B 33/0005 280/47.38
2005/0241064 A1 * 11/2005 Lopes ..... A47D 9/016 5/655
2008/0001450 A1 * 1/2008 Yang ..... A47D 5/00 297/219.12
2008/0196164 A1 * 8/2008 Calilung ..... A47D 9/057 5/101
2016/0106226 A1 * 4/2016 Yi ..... A47D 9/012 5/11
2017/0238721 A1 * 8/2017 Damiani ..... A47D 15/008
2017/0360216 A1 * 12/2017 Sclare ..... A47D 9/02
2019/0099012 A1 * 4/2019 Zhang ..... A47D 15/00
2022/0142377 A1 * 5/2022 Zhang ..... A47D 15/00
2022/0330713 A1 * 10/2022 Yang ..... A47D 9/00
2023/0200558 A1 * 6/2023 Yang ..... A47D 9/012 5/98.1
2023/0200559 A1 * 6/2023 Yang ..... A47D 9/008 5/108
2023/0337837 A1 * 10/2023 Mo ..... A47D 9/02
2023/0346134 A1 * 11/2023 Yang ..... A47D 7/007

FOREIGN PATENT DOCUMENTS

CN 113142899 A 7/2021
CN 215015559 U 12/2021
EP 4205604 A1 * 7/2003 ..... A47D 9/008
EP 4205605 A1 * 7/2003 ..... A47D 9/012
EP 4268677 A1 * 11/2023 ..... A47D 7/005
EP 4205604 B1 * 4/2024 ..... A47D 9/008
EP 4205605 B1 * 10/2024 ..... A47D 9/012
EP 4268677 B1 * 11/2024 ..... A47D 9/00

* cited by examiner

CRIB

CROSS REFERENCE TO THE RELATED APPLICATIONS

This application is based upon and claims priority to Chinese Patent Application No. 202220999504.9, filed on Apr. 28, 2022, the entire contents of which are incorporated herein by reference.

TECHNICAL FIELD

The present disclosure relates to the field of children's products, and in particular to a crib.

BACKGROUND

Cribs are beds specially designed for babies. There are various types of cribs available. The prior crib includes a left support mechanism, a right support mechanism, and a sleeping basket provided between the left support mechanism and the right support mechanism. Most of the prior cribs provide only a space for the baby to sleep, and do not have the function of storing baby items. To change the baby's diaper or clothing in the crib, the parent needs to get the diaper or clothing from other places in advance, which is inconvenient.

SUMMARY

In order to solve the above-mentioned problem existing in the prior art, an objective of the present disclosure is to provide a crib.

A crib includes a left support mechanism, a right support mechanism, and a sleeping basket frame provided between the left support mechanism and the right support mechanism. The sleeping basket frame is height-adjustable. A detachable support frame and a detachable storage frame are further provided between the left support mechanism and the right support mechanism. The support frame is located below the sleeping basket frame, and the storage frame is located below the support frame.

Further, each of the left support mechanism and the right support mechanism may include a support base, an inner sleeve, an outer sleeve, and a connecting housing. A bottom portion of the inner sleeve may be connected to a top portion of the support base, and an upper portion of the inner sleeve may be nested inside a lower portion of the outer sleeve. The connecting housing may be provided on a top portion of the outer sleeve. The sleeping basket frame may be provided between the connecting housing of the left support mechanism and the connecting housing of the right support mechanism.

Further, a top portion of the inner sleeve may be provided with a height adjustment box. A height adjustment piece and a clamping rod may be provided in the height adjustment box. The height adjustment piece may be configured to drive the clamping rod to move left and right. The connecting housing may be provided with a pulling assembly. A pulling rope may be provided between the pulling assembly and the height adjustment piece. A side of the outer sleeve may be provided with a plurality of clamping openings arranged vertically. One end of the clamping rod passes through a side of the height adjustment box and may be clamped into the clamping opening.

Further, a bottom portion of the outer sleeve may be provided with a first connecting portion. The first connecting portion may be located on a side of the outer sleeve. The first connecting portion may be provided with an inserting hole. An inserting piece adapted to the inserting hole may be provided in the inserting hole. A top portion of the inserting piece protrudes out of a top portion of the inserting hole and may be connected to the support frame.

Further, an outer side of the lower portion of the outer sleeve may be provided with a height observation window. An outer side of the inner sleeve may be provided with a plurality of height marks spaced vertically. The height mark may correspond to the height observation window.

Further, an inner side of the support base may be provided with a second connecting portion. A side of the second connecting portion may be provided with an inserting portion. A third connecting portion may be provided on the side of the second connecting portion. A side of the third connecting portion adjacent to the second connecting portion may be provided with an inserting slot with an open bottom. The inserting portion may be adapted to the inserting slot and may be inserted into the inserting slot. The third connecting portion may be connected to the storage frame.

Further, the support base may include a front bending rod and a rear bending rod that may be symmetrical to each other. A front end of the front bending rod may be provided with a front connecting base, and a rear end of the rear bending rod may be provided with a telescopic tube. A rear end of the telescopic tube may be provided with a rear connecting base. Each of a bottom portion of the front connecting base and a bottom portion of the rear connecting base may be provided with a caster. A top portion of the front bending rod and a top portion of the rear bending rod may be connected to a coupling portion. The bottom portion of the inner sleeve may be connected to the coupling portion.

Further, a front end of the telescopic tube may extend into the rear end of the rear bending rod, and a top surface of the telescopic tube may be provided with a clamping hole. A V-shaped elastic piece may be provided in the telescopic tube, and the V-shaped elastic piece may be provided with a clamping head. The clamping head may protrude out of the clamping hole and may be located at a rear side of the rear end of the rear bending rod. A spring abutting against the telescopic tube may be provided in the rear bending rod.

Further, the sleeping basket frame may include a U-shaped tube, a left connecting tube, a right connecting tube, and a detachable tube. Two ends of the U-shaped tube may be respectively connected to the left connecting tube and the right connecting tube through the connecting housing of the left support mechanism and the connecting housing of the right support mechanism. The detachable tube may be detachably provided between the left connecting tube and the right connecting tube.

According to the description of the present disclosure, compared with the prior art, the present disclosure has the following advantages. The present disclosure has a novel structure and clever design. A sleeping basket is height-adjustable, so the height of the sleeping basket can be adjusted according to actual needs. The storage frame is configured to support a storage basket for storing baby items, such as diapers and clothes. Therefore, it is convenient for the parent to get the diaper or clothing from the storage basket to change the baby.

DETAILED DESCRIPTION OF THE EMBODIMENTS

Figure 1:
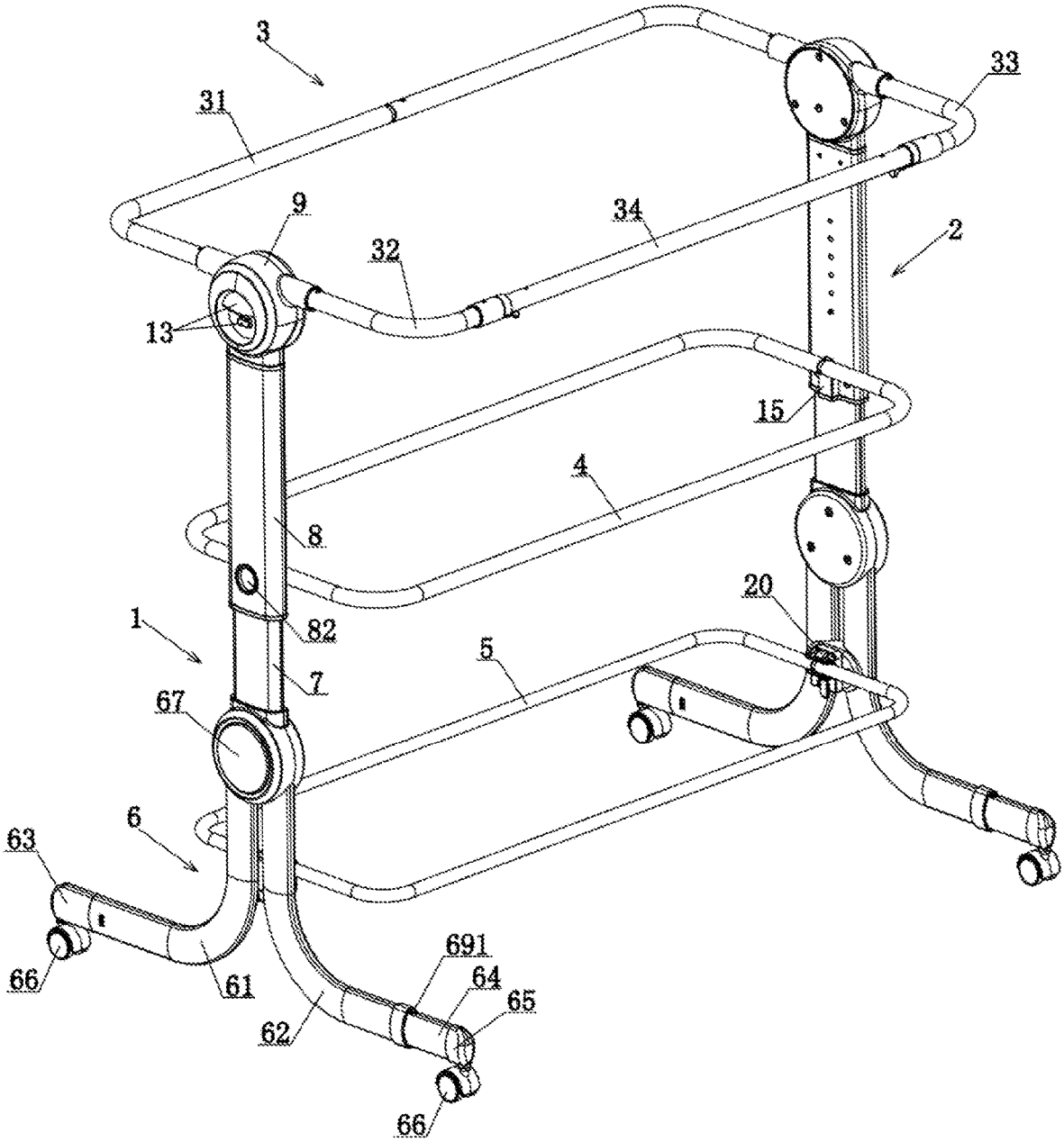
FIG. 1 is a structural view of a crib according to the present disclosure.

The present disclosure provides a crib. As shown in FIG. 1, the crib includes a left support mechanism 1, a right support mechanism 2, and a sleeping basket frame 3 provided between the left support mechanism 1 and the right support mechanism 2. The sleeping basket frame 3 is height-adjustable. A detachable support frame 4 and a detachable storage frame 5 are further provided between the left support mechanism 1 and the right support mechanism 2. The support frame 4 is located below the sleeping basket frame 3, and the storage frame 5 is located below the support frame 4.

Figure 2:
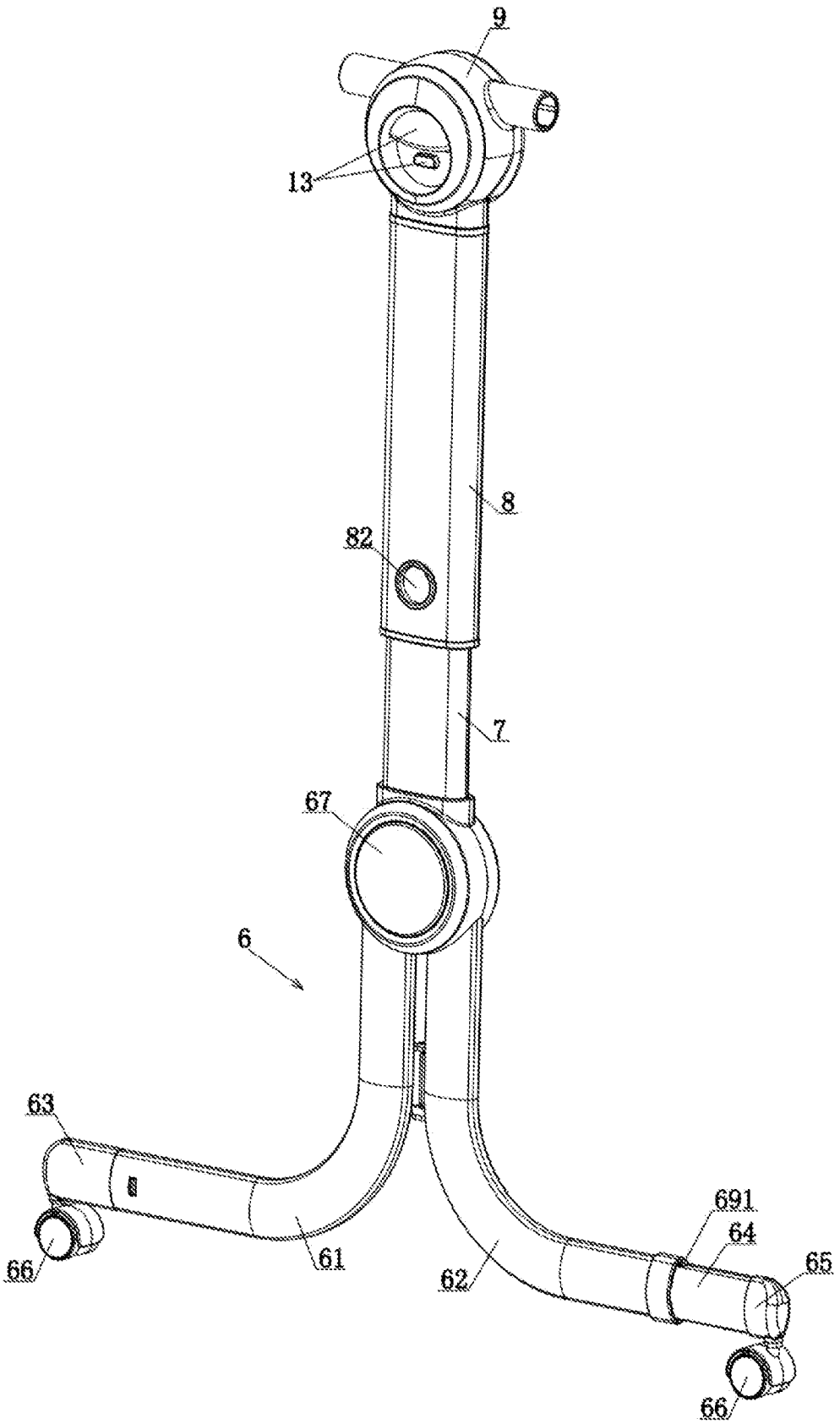
FIG. 2 is a structural view of a left support mechanism according to the present disclosure.

Referring to FIGS. 1 and 2, each of the left support mechanism 1 and the right support mechanism 2 includes a support base 6, an inner sleeve 7, an outer sleeve 8, and a connecting housing 9. A bottom portion of the inner sleeve 7 is connected to a top portion of the support base 6, and an upper portion of the inner sleeve 7 is nested inside a lower portion of the outer sleeve 8. The connecting housing 9 is provided on a top portion of the outer sleeve 8. The sleeping basket frame 3 is provided between the connecting housing 9 of the left support mechanism 1 and the connecting housing 9 of the right support mechanism 2.

Referring to FIGS. 1 to 5, a top portion of the inner sleeve 7 is provided with a height adjustment box 10. A height adjustment piece 11 and a clamping rod 12 are provided in the height adjustment box 10. The height adjustment piece 11 is configured to drive the clamping rod 12 to move left and right. The connecting housing 9 is provided with a pulling assembly 13. A pulling rope 14 is provided between the pulling assembly 13 and the height adjustment piece 11. A side of the outer sleeve is provided with a plurality of clamping openings 81 arranged vertically. One end of the clamping rod 12 passes through a side of the height adjustment box 10 and is clamped into the clamping opening 81. The pulling assembly 13 is a prior structure, which will not be repeated herein. The pulling assembly 13 drives the height adjustment piece 11 to rise and fall through the pulling rope 14. The connection relationship between the height adjustment piece 11 and the clamping rod 12 is in the prior art. When the height adjustment piece 11 rises, the clamping rod 12 is moved and separated from the clamping opening 81. At this time, the outer sleeve 8 and the sleeping basket frame 3 can be raised and lowered. When the outer sleeve 8 and the sleeping basket frame 3 are adjusted to a desired height, the height adjustment piece 11 is lowered, and the clamping rod 12 is clamped into a new clamping opening 81. An outer side of the lower portion of the outer sleeve 8 is provided with a height observation window 82. An outer side of the inner sleeve 7 is provided with a plurality of height marks spaced vertically (not shown in the figure). The height mark (not shown in the figure) corresponds to the height observation window 82, and the height observation window 82 is configured to display a position of the height mark on the outer sleeve 8.

Figure 4:
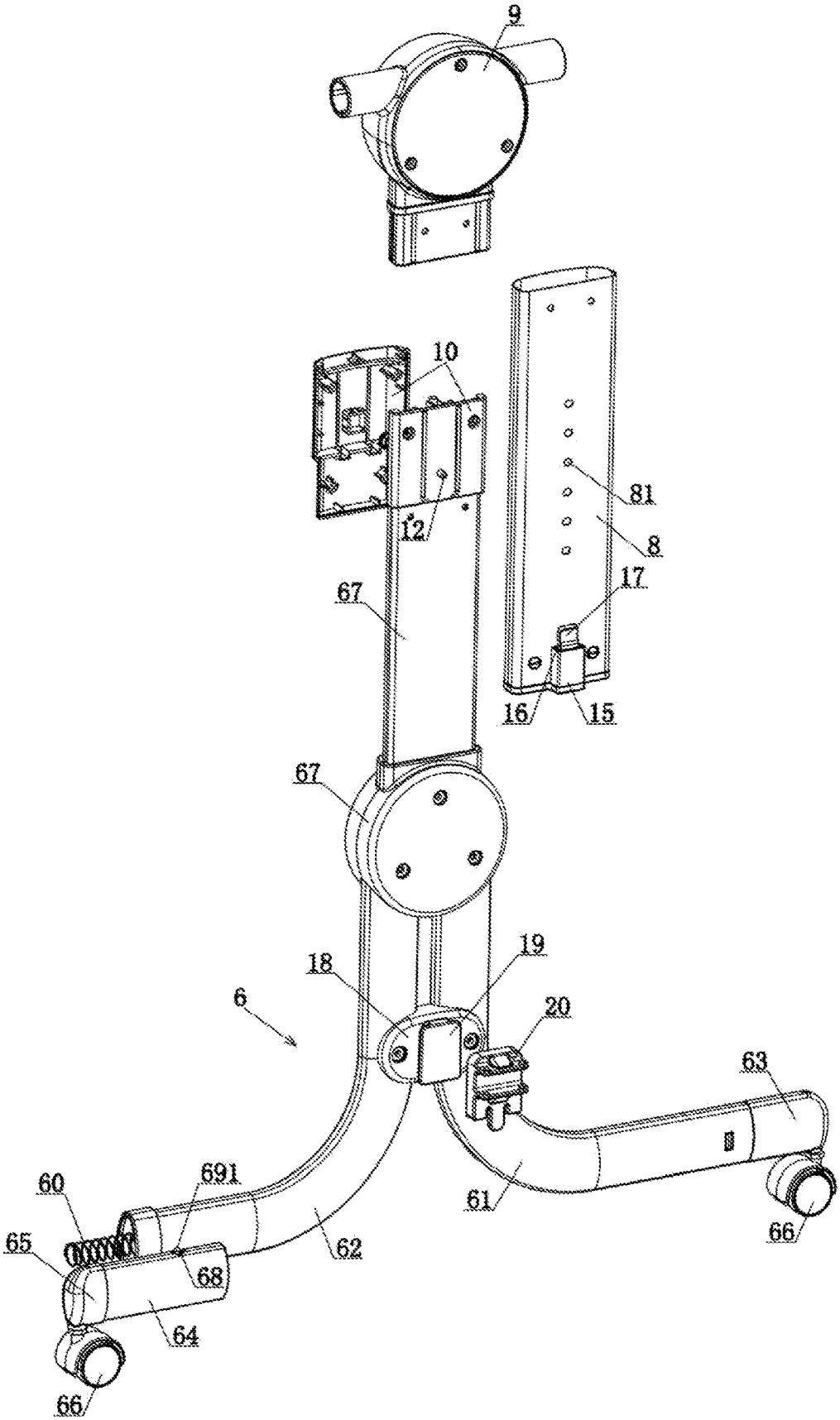
FIG. 4 is an exploded view of the left support mechanism shown in FIG. 3 from another perspective.
Figure 5:
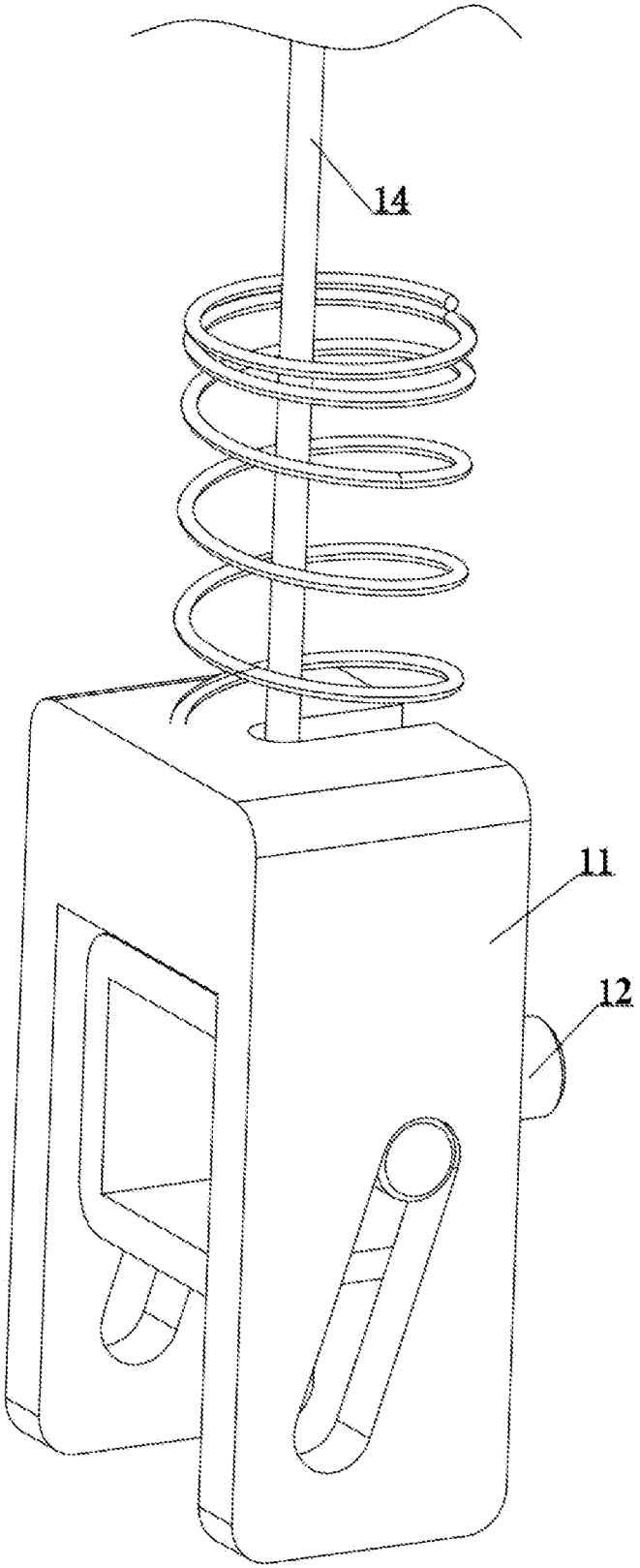
FIG. 5 is a structural view of a height adjustment piece connected to a clamping rod according to the present disclosure.
Figure 6:
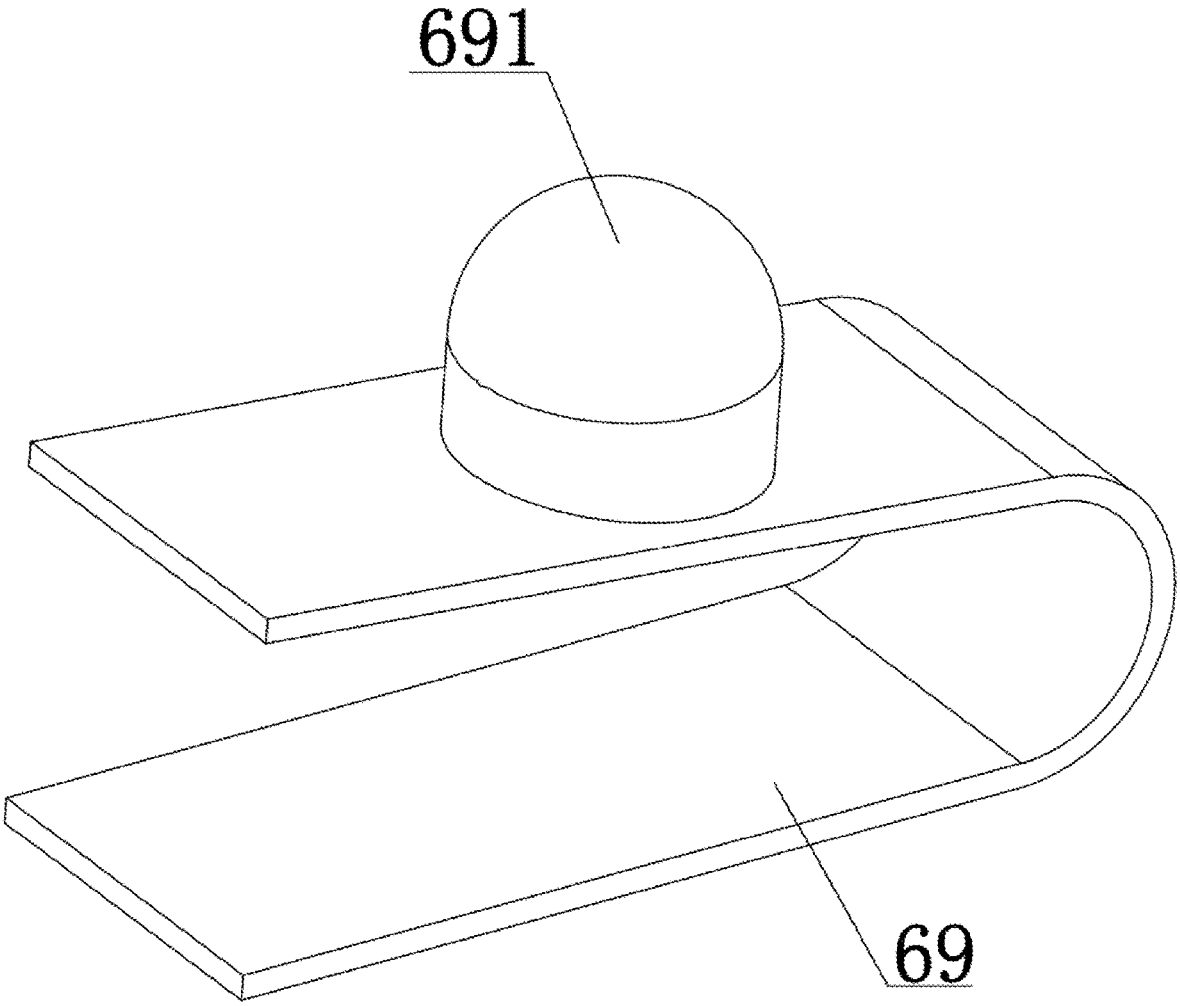
FIG. 6 is a structural view of a V-shaped elastic piece according to the present disclosure.

Referring to FIGS. 1 and 4, a bottom portion of the outer sleeve 8 is provided with a first connecting portion 15. The first connecting portion 15 is located on a side of the outer sleeve 8. The first connecting portion 15 is provided with an inserting hole 16. An inserting piece 17 adapted to the inserting hole 16 is provided in the inserting hole 16. A top portion of the inserting piece 17 protrudes out of a top portion of the inserting hole 16 and is connected to the support frame 4. Since the support frame 4 is connected to the inserting piece 17, the support frame 4 is connected to the outer sleeve 8 by directly inserting the inserting piece 17 into the inserting hole 16. To remove the support frame 4, the inserting piece 17 is directly lifted and taken out of the inserting hole 16.

Figure 3:
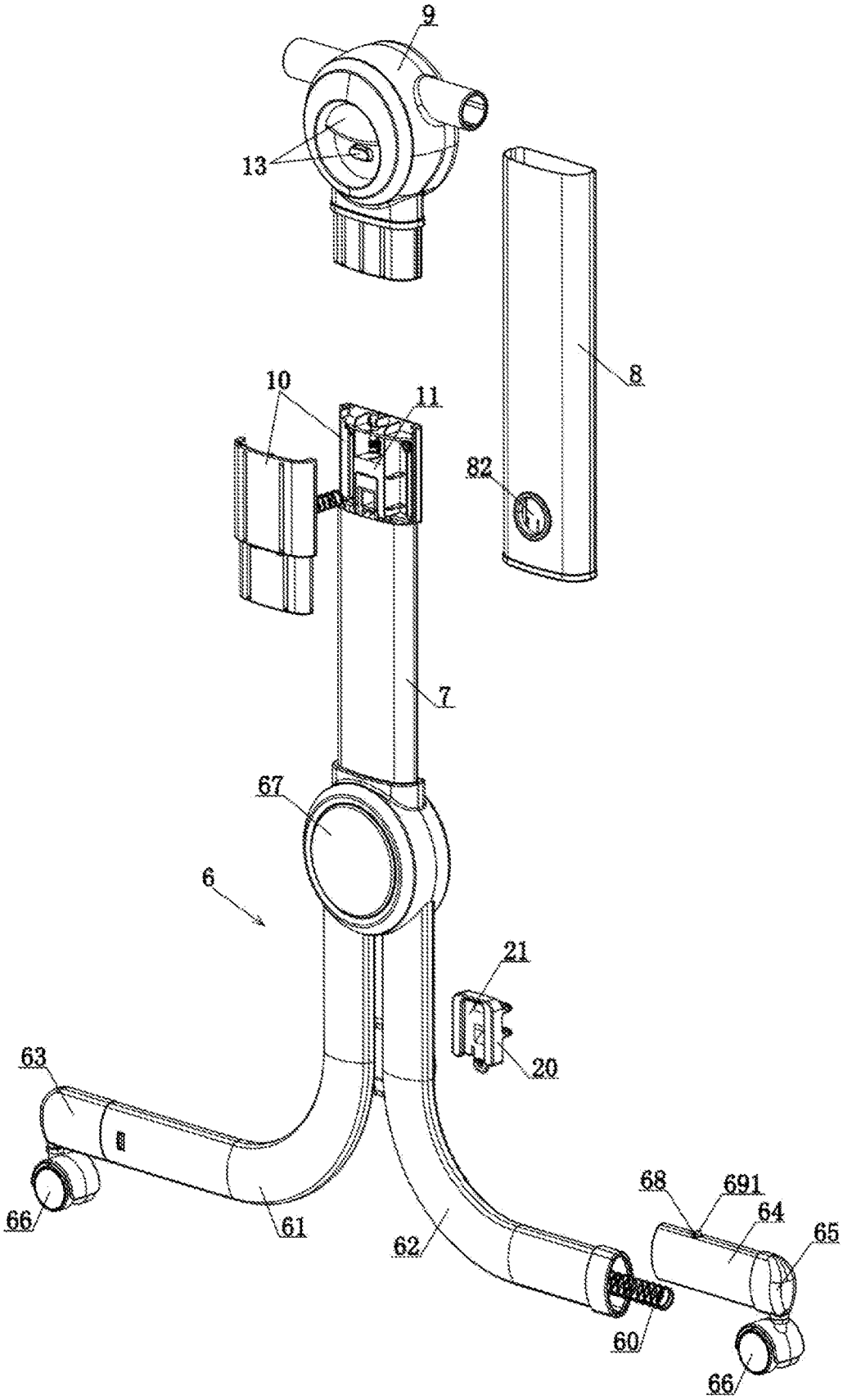
FIG. 3 is an exploded view of the left support mechanism according to the present disclosure.

Referring to FIGS. 1, 3 and 4, an inner side of the support base 6 is provided with a second connecting portion 18. A side of the second connecting portion 18 is provided with an inserting portion 19. A third connecting portion 20 is provided on the side of the second connecting portion 18. A side of the third connecting portion 20 adjacent to the second connecting portion 18 is provided with an inserting slot 21 with an open bottom. The inserting portion 19 is adapted to the inserting slot 21 and is inserted into the inserting slot 21. The third connecting portion 20 is connected to the storage frame 5. To connect the storage frame 5 to the support base 6, the inserting portion 19 is inserted into the inserting slot 21. To remove the storage frame 5, the storage frame 5 is directly lifted up, such that the inserting portion 19 is separated from the inserting slot 21. The storage frame 5 is configured to support a storage basket for storing baby items, such as diapers and clothes.

Referring to FIGS. 1 to 4, the support base 6 includes a front bending rod 61 and a rear bending rod 62 that are symmetrical to each other. A front end of the front bending rod 61 is provided with a front connecting base 63, and a rear end of the rear bending rod 62 is provided with a telescopic tube 64. A rear end of the telescopic tube 64 is provided with a rear connecting base 65. Each of a bottom portion of the front connecting base 63 and a bottom portion of the rear connecting base 65 is provided with a caster 66. A top portion of the front bending rod 61 and a top portion of the rear bending rod 62 are connected to a coupling portion 67. The bottom portion of the inner sleeve 7 is connected to the coupling portion 67. A front end of the telescopic tube 64 extends into the rear end of the rear bending rod 62, and a top surface of the telescopic tube 64 is provided with a clamping hole 68. A V-shaped elastic piece 69 is provided in the telescopic tube 64, and the V-shaped elastic piece 69 is provided with a clamping head 691. The clamping head 691 protrudes out of the clamping hole 68 and is located at a rear side of the rear end of the rear bending rod 62. A spring 60 abutting against the telescopic tube 64 is provided in the rear bending rod 62.

Referring to FIGS. 1 to 4, when it is necessary to place the crib adjacent to an adult bed to take care of the baby, the clamping head 691 of the V-shaped elastic piece 69 is pressed such that the clamping head 691 does not abut against the rear side of the rear end of the rear bending rod 62. At this time, the telescopic tube 64 can be retracted. Then, the crib is tied to the adult bed tightly with a strap. To untie the crib from the adult bed, the strap is loosened. Under the action of the spring 60, the telescopic tube 64 automatically returns to an original position, and the clamping head 691 of the V-shaped elastic piece 69 is re-clamped into the clamping hole 68.

Referring to FIG. 1, the sleeping basket frame 3 includes a U-shaped tube 31, a left connecting tube 32, a right connecting tube 33, and a detachable tube 34. Two ends of the U-shaped tube 31 are respectively connected to the left connecting tube 32 and the right connecting tube 33 through the connecting housing 9 of the left support mechanism 1 and the connecting housing 9 of the right support mechanism 2. The detachable tube 34 is detachably provided between the left connecting tube 32 and the right connecting tube 33. The disassembly method of the detachable tube 34 is disclosed in the prior art, and will not be repeated herein. The detachable tube 34 can be removed so the parent can pick up the baby from the crib easily and attach the crib to a bed that the parent is sleeping in so the parent can co-sleep with the baby and has easy access to the baby.

The above described are merely specific implementations of the present disclosure, but the design concept of the present disclosure is not limited thereto. Any non-substantial changes made to the present disclosure based on the concept of the present disclosure should fall within the protection scope of the present disclosure.

What is claimed is:

1. A crib, comprising a left support mechanism, a right support mechanism, and a sleeping basket frame provided between the left support mechanism and the right support mechanism, wherein the sleeping basket frame is height-adjustable; a detachable support frame and a detachable storage frame are further provided between the left support mechanism and the right support mechanism; and the detachable support frame is located below the sleeping basket frame, and the detachable storage frame is located below the detachable support frame;

wherein each of the left support mechanism and the right support mechanism comprises a support base, an inner sleeve, an outer sleeve, and a connecting housing; a bottom portion of the inner sleeve is connected to a top portion of the support base, and an upper portion of the inner sleeve is nested inside a lower portion of the outer sleeve; the connecting housing is provided on a top portion of the outer sleeve; and the sleeping basket frame is provided between the connecting housing of the left support mechanism and the connecting housing of the right support mechanism; and wherein a bottom portion of the outer sleeve is provided with a first connecting portion; the first connecting portion is located on a side of the outer sleeve; the first connecting portion is provided with an inserting hole; an inserting piece adapted to the inserting hole is provided in the inserting hole; and a top portion of the inserting piece protrudes out of a top portion of the inserting hole, and the top portion of the inserting piece is connected to the detachable support frame.

2. A crib, comprising a left support mechanism, a right support mechanism, and a sleeping basket frame provided between the left support mechanism and the right support mechanism, wherein the sleeping basket frame is height-adjustable; a detachable support frame and a detachable storage frame are further provided between the left support mechanism and the right support mechanism; and the detachable support frame is located below the sleeping basket frame, and the detachable storage frame is located below the detachable support frame;

wherein each of the left support mechanism and the right support mechanism comprises a support base, an inner sleeve, an outer sleeve, and a connecting housing; a bottom portion of the inner sleeve is connected to a top portion of the support base, and an upper portion of the inner sleeve is nested inside a lower portion of the outer sleeve; the connecting housing is provided on a top portion of the outer sleeve; and the sleeping basket frame is provided between the connecting housing of the left support mechanism and the connecting housing of the right support mechanism; and wherein an inner side of the support base is provided with a second connecting portion; a side of the second connecting portion is provided with an inserting portion; a third connecting portion is provided on the side of the second connecting portion; a side of the third connecting portion is provided with an inserting slot with an open bottom, wherein the side of the third connecting portion is adjacent to the second connecting portion; the inserting portion is adapted to the inserting slot, and the inserting portion is inserted into the inserting slot; and the third connecting portion is connected to the detachable storage frame.

3. A crib, comprising a left support mechanism, a right support mechanism, and a sleeping basket frame provided between the left support mechanism and the right support mechanism, wherein the sleeping basket frame is height-adjustable; a detachable support frame and a detachable storage frame are further provided between the left support mechanism and the right support mechanism; and the detachable support frame is located below the sleeping basket frame, and the detachable storage frame is located below the detachable support frame;

wherein each of the left support mechanism and the right support mechanism comprises a support base, an inner sleeve, an outer sleeve, and a connecting housing; a bottom portion of the inner sleeve is connected to a top portion of the support base, and an upper portion of the inner sleeve is nested inside a lower portion of the outer sleeve; the connecting housing is provided on a top portion of the outer sleeve; and the sleeping basket frame is provided between the connecting housing of the left support mechanism and the connecting housing of the right support mechanism;

wherein the support base comprises a front bending rod and a rear bending rod, wherein the front bending rod and the rear bending rod are symmetrical to each other; a front end of the front bending rod is provided with a front connecting base, and a rear end of the rear bending rod is provided with a telescopic tube; a rear end of the telescopic tube is provided with a rear connecting base; each of a bottom portion of the front connecting base and a bottom portion of the rear connecting base is provided with a caster; a top portion of the front bending rod and a top portion of the rear bending rod are connected to a coupling portion; and the bottom portion of the inner sleeve is connected to the coupling portion; and wherein a front end of the telescopic tube extends into the rear end of the rear bending rod, and a top surface of the telescopic tube is provided with a clamping hole; a V-shaped elastic piece is provided in the telescopic tube, and the V-shaped elastic piece is provided with a clamping head; the clamping head protrudes out of the clamping hole, and the clamping head is located at a rear side of the rear end of the rear bending rod; and a spring abutting against the telescopic tube is provided in the rear bending rod.

* * * * *